US006759801B1

(12) United States Patent
Snijkers-Hendrickx et al.

(10) Patent No.: US 6,759,801 B1
(45) Date of Patent: Jul. 6, 2004

(54) LOW-PRESSURE MERCURY VAPOR DISCHARGE LAMP

(75) Inventors: Ingrid Jozef Maria Snijkers-Hendrickx, Eindhoven (NL); Henricus Albertus Maria Van Hal, Eindhoven (NL); Volker Dirk Hildenbrand, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 241 days.

(21) Appl. No.: 09/718,258

(22) Filed: Nov. 22, 2000

(30) Foreign Application Priority Data

Nov. 30, 1999 (EP) ..... 99204038

(51) Int. Cl.[7] ..... H01J 63/04

(52) U.S. Cl. ..... 313/489; 313/485; 313/486; 313/635

(58) Field of Search ..... 313/489, 485, 313/483, 486, 635, 110, 112

(56) References Cited

U.S. PATENT DOCUMENTS 5,391,959 A * 2/1995 Labib et al. ..... 313/486
5,753,999 A 5/1998 Roozekrans et al. ..... 313/489
5,905,333 A * 5/1999 Tomura et al. ..... 313/485

* cited by examiner

*Primary Examiner*—Edward J. Glick
*Assistant Examiner*—Elizabeth Keaney

(57) ABSTRACT

The low-pressure mercury vapor discharge lamp has a filling of mercury and an inert gas, and the glass discharge vessel (1) is provided on the inner surface (4) of the wall (3) with a film (6) of trifluoride and/or oxyfluoride of at least one element, which is trivalent at most, which is selected from lanthanides, lanthanum, scandium and yttrium. The film (6) counteracts transport of mercury from the discharge vessel to the wall (3) and of alkali from the wall (3) to the discharge vessel. In this manner, a decrease of the lamp's efficiency and of the service life are counteracted.

3 Claims, 1 Drawing Sheet

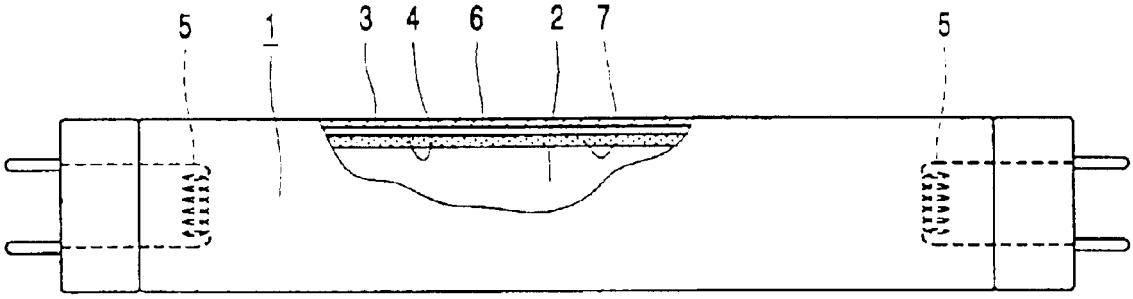
5
1
3
4
6
2
7
5

LOW-PRESSURE MERCURY VAPOR DISCHARGE LAMP

FIELD OF THE INVENTION

The present invention relates to a low pressure mercury vapor electric discharge lamp and a method of manufacturing the lamp, and more specifically, to a low pressure mercura vapor discharge lamp including a discharge vessel having a coating which counteracts transport of mercury from the filling to the wall of the discharge vessel and of alkali ions from the wall of the discharge vessel to the filling.

The invention relates to a low-pressure mercury vapor discharge lamp comprising:

a discharge vessel which is closed in a gastight manner and which encloses a discharge space, which discharge vessel has a wall of glass containing alkali ions with an inner surface;

a filling, which comprises an inert gas and mercury, in the discharge vessel, and means for maintaining all electric discharge in the discharge vessel, the inner surface of the discharge vessel having a coating which counteracts transport of mercury from the filling to the wall of the discharge vessel and of alkali ions from the wall of the discharge vessel to the filling.

Such a low-pressure mercury vapor discharge lamp is known from U.S. Pat. No. 5,753,999.

To preserve the efficiency of the low-pressure mercury vapor discharge lamp, it is important that the extraction of mercury from the filling of the lamp is counteracted. Without special measures, mercury ions can be absorbed in the wall of the discharge vessel where they can be reduced to metallic mercury. The resultant blackening blocks radiation generated by the lamp, thereby reducing the efficiency of the lamp. In addition, the mercury pressure in the lamp decreases, which also adversely affects the efficiency. Also migration of alkali ions from the wall to the filling leads to a reduction of the efficiency of the lamp since amalgam is formed and the mercury pressure decreases. The decreasing mercury pressure also leads to a reduction of the service life of the lamp.

For reasons relating to the cost price of the lamp and protection of the environment preferably, the consequences of the extraction of mercury from the discharge are not counteracted by providing the lamp with an excess of mercury.

In the known lamp, a layer of $SiO_2$ is applied directly to the wall of the discharge vessel, which layer counteracts the migration of alkali ions. At the surface of said layer facing the discharge space, the lamp is provided with a powder coating of an oxide, such as yttrium oxide. This layer impedes the transport of mercury to the wall of the discharge vessel. To this end, the powder of the layer must have a grain size below 1 $\mu$m.

It is a drawback of the known lamp that, in order to counteract interaction of mercury from the filling with the wall and with components from the wall of the discharge vessel, a coating consisting of two layers must be provided on the wall. This makes the manufacture of the lamp more difficult.

SUMMARY OF THE INVENTION

It is an object of the invention to provide a low-pressure mercury vapor discharge lamp of the type described in the opening paragraph, wherein, despite the simple structure of the lamp, the loss of mercury from the filling due to interaction with the all and with constituents thereof is effectively counteracted.

In accordance with the invention, this object is achieved in that the inner surface is coated with a film which comprises at least a compound selected from the group formed by trifluorides and oxyfluorides of an at most trivalent element selected from lanthanides, lanthanum, scandium and yttrium.

The film effectively counteracts the transport of both mercury ions to the wall and alkali ions to the filling. As a result, an important cause of the decrease in efficiency of the lamp with increasing burning hours is counteracted. The fact is that the trifluorides and oxyfluorides of the above-mentioned trivalent metals are not ion conducting. Cerium and terbium, which belong to the lanthanides, which include elements having atomic number 58 through 71, are not only trivalent but also tetravalent. In order to exclude the presence of tetravalent cerium and terbium compounds, which are ion conducting, the use of cerium and terbium is excluded.

The film can be readily provided by applying a solution of a fluorine-containing compound, or of a fluorine and oxygen-containing compound, of the selected metal to the inner surface of the wall of the discharge vessel, removing the solvent and heating the compound to decompose it into the trifluoride and/or oxyfluoride of the metal. For this purpose, it is favorable to use low-molecular organic acid residues, such as trifluoroacetate.

In a special embodiment of the lamp in accordance with the invention, the wall is provided, on a side of the film facing the discharge space, with a coating comprising a luminescent material. This film has the advantage that it is resistant to water and anionic surface-active substances, so that the luminescent material can be provided as an aqueous suspension. Customary volatile organic dispersion agents, such as butylacetate, can thus be avoided.

It is favorable if the film comprises yttrium fluoride and/or yttrium oxyfluoride. Yttrium is cheaper than most lanthanides and it has already been used in low-pressure mercury vapor discharge lamps as a mercury barrier and, doped with europium as a luminescent material.

For the luminescent material, the lamp may comprise a substance which emits radiation in a wide band of the visible spectrum. On the other hand, two or more substances, mixed or not, may be present which each emit in a different yet complementary part of the visible spectrum, for example in the red and the green part, or in the red, the green and the blue part. UV radiation generated by the discharge is converted by the materials to visible radiation. The film on the inner surface of the i all of the discharge vessel does not have this effect.

The means for maintaining an electric discharge may consist of an electrode pair in the discharge vessel. They may alternatively consist of an electrode in the discharge vessel and an electrode on the outside, near the discharge vessel or in contact with the discharge vessel. On the other hand, these means may comprise an electric coil, which is situated outside the discharge space, for example in a recessed portion of the discharge vessel, so that the discharge surrounds the coil.

The discharge vessel may have various shapes and dimensions. For example, the discharge vessel may be a linear tube or a curved tube. It may be composed of various straight tubular portions, which are connected in series. On the other hand, the discharge vessel may be, for example, spherical or oval or pear-shaped.

The lamp can suitably be exposed to high loads, for example 500 $W/m^2$ or higher.

BRIEF DESCRIPTION OF THE DRAWINGS

FIG. 1 is a partial cut away side view of an embodiment of the low-pressure mercury vapor discharge lamp in accordance with the invention.

DETAILED DESCRIPTION OF THE INVENTION

FIG. 1 illustrates an embodiment of the low-pressure mercury vapor discharge lamp comprising a gastight discharge vessel 1 which encloses a discharge space 2 and which includes a wall 3 of glass containing alkali ions with an inner surface 4. The discharge vessel 1 contains a filling which comprises an inert gas and mercury. The lamp has means 5, in the drawing an electrode pair, for maintaining an electric discharge in the discharge vessel 1. The inner surface 4 of the discharge vessel 1 has a coating which serves to counteract transport of mercury from the filling to the wall 3 of the discharge vessel 1 and of alkali ions from the wall 3 of the discharge vessel 1 to the filing.

For this purpose, the inner surface 4 is coated with a film 6 which at least comprises a compound selected from the group formed by trifluorides and oxyfluorides of an at most trivalent element selected from lanthanides, lanthanum, scandium and yttrium.

In the case of the lamp shown, the wall 3 is provided, on a side of the film 6 facing the discharge space 2, with a coating 7 comprising luminescent material: $Y_2O_3$ activated with $Eu^{111}$ (YOX), cerium-magnesium-aluminate activated with Tb (CAT) and barium-magnesium-aluminate activated with $Eu^{11}$ (BAM).

The film 6 at least comprises a compound selected from yttrium oxyfluoride and yttrium fluoride; in the selected lamp use is made of a combination of these substances.

The film was obtained by applying a solution of 1.25 g yttrium trifluoroacetate in 100 ml water, driving out the solvent and heating the discharge vessel, for example for 5 minutes, to, for example, 500° C. On the other hand, also solutions in other solvents, such as ethanol, and more concentrated or less diluted solutions, such as 0.5 to 5% by weight solutions, for example 1 to 3% by weight solutions, can be used. Luminescent material was applied by providing a suspension of YOX, CAT and BAM in water and subsequently drying it. The luminescent material was sintered, whereafter the discharge vessel was evacuated, provided with mercury and an inert gas and sealed in a vacuumtight manner. Heating the film may coincide with sintering the luminescent material. The resultant film had a thickness of approximately 10 nm. However, the thickness of the film may also be chosen to be larger or smaller, for example at least approximately 1 nm to approximately 50 nm. If the films are thinner, there is a risk that the film is not closed, while thicker films only require additional material.

What is claimed is:

1. A low-pressure mercury vapor discharge lamp comprising:

a discharge vessel (1) which is closed in a gastight manner and which encloses a discharge space (2), which discharge vessel has a wall (3) of glass containing alkali ions with an inner surface (4);

a filling, which comprises an inert gas and mercury, in the discharge vessel (1), and means (5) for maintaining an electric discharge in the discharge vessel (1), the inner surface (4) of the discharge vessel (1) is coated with a non-luminescent film (6) which counteracts transport of mercury from the filling to the wall (3) of the discharge vessel (1) and of alkali ions from the wall (3) of the discharge vessel (1) to the filling, wherein the non-luminescent film (6) comprises at least a compound selected from the trifluorides and oxyfluorides of yttrium.

2. A low-pressure mercury vapor discharge lamp as claimed in claim 1, characterized in that the wall (3) is provided, on a side of the film (6) facing the discharge space (2), with a coating (7) comprising a luminescent material.

3. A low-pressure mercury vapor discharge lamp as claimed in claims 1 or 2, characterized in that the film (6) comprises at least a compound selected from yttriumoxyfluoride and yttriumtrifluoride.

* * * * *